US011827509B2

(12) United States Patent
Krystinik et al.

(10) Patent No.: US 11,827,509 B2
(45) **Date of Patent: *Nov. 28, 2023**

(54) DISPENSING SYSTEM FOR DISPENSING A LIQUID FROM A REPLACEMENT CONTAINER

(71) Applicant: Henkel AG & Co. KGaA, Duesseldorf (DE)

(72) Inventors: Andrew Bell Krystinik, Middlefield, CT (US); Alexander Borgestedt, Shelton, CT (US); George Wells, Boston, MA (US)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

This patent is subject to a terminal disclaimer.

(21) Appl. No.: 18/072,354

(22) Filed: Nov. 30, 2022

(65) Prior Publication Data

US 2023/0093353 A1 Mar. 23, 2023

Related U.S. Application Data

(63) Continuation of application No. 17/702,401, filed on Mar. 23, 2022, now Pat. No. 11,667,512.
(Continued)

(51) Int. Cl.
*B67D 3/00* (2006.01)
*A47K 5/13* (2006.01)
*B65D 47/38* (2006.01)

(52) U.S. Cl.
CPC ..... *B67D 3/0032* (2013.01); *A47K 5/13* (2013.01); *B65D 47/38* (2013.01)

(58) Field of Classification Search
CPC ..... B67D 3/0032; B65D 47/38; A47K 5/13
(Continued)

(56) References Cited

U.S. PATENT DOCUMENTS 3,169,690 A * 2/1965 Scholle ..... B65D 47/248 229/131.1
3,206,075 A * 9/1965 Scholle ..... B67D 3/045 222/105

(Continued)

FOREIGN PATENT DOCUMENTS

EP 0 553 956 A1 8/1993
EP 553956 A1 * 8/1993 ..... B65D 77/067

(Continued)

*Primary Examiner* — Paul R Durand
*Assistant Examiner* — Michael J. Melaragno
(74) *Attorney, Agent, or Firm* — Sterne, Kessler, Goldstein & Fox P.L.L.C.

(57) ABSTRACT

A dispensing system including a container and a dispenser. In some embodiments, the container includes a container body, a dispensing opening, and a seal over the dispensing opening. In some embodiments, the dispenser includes a base, a drawer, a piercing tube, and a dispensing tap. In some embodiments, the base is configured to receive the container. In some embodiments, the drawer is moveable relative to the base between a first position and a second position. In some embodiments, the piercing tube is coupled to and moveable with the drawer. In some embodiments, the dispensing tap is in fluid communication with the piercing tube. In some embodiments, the piercing tube is configured to pierce the seal of container when the container is received in the base and the drawer is moved from the first position to the second position.

20 Claims, 9 Drawing Sheets

Related U.S. Application Data

(60) Provisional application No. 63/166,665, filed on Mar. 26, 2021.

(58) Field of Classification Search
USPC ..... 222/135
See application file for complete search history.

(56) References Cited

U.S. PATENT DOCUMENTS 3,239,104 A * 3/1966 Scholle ..... B67B 7/28 222/88
3,252,634 A * 5/1966 Scholle ..... B65D 47/283 222/105
3,325,058 A * 6/1967 West, Jr. ..... B67D 3/0083 219/433
4,085,870 A 4/1978 Von Holdt
4,370,007 A * 1/1983 Fler ..... A47B 88/493 312/333
4,440,316 A 4/1984 Christine
4,516,691 A 5/1985 Christine et al.
4,759,341 A * 7/1988 McFarland ..... F24C 15/168 126/339
4,913,713 A 4/1990 Bender et al.
4,921,135 A 5/1990 Pleet
5,102,015 A 4/1992 Barnard et al.
5,335,829 A * 8/1994 Sovann ..... B67D 1/0835 D7/307
5,337,775 A 8/1994 Lane et al.
5,348,192 A 9/1994 Sardynski et al.
5,466,060 A * 11/1995 Hoffman ..... A47B 88/493 312/334.44
5,673,817 A 10/1997 Mullen et al.
5,868,479 A * 2/1999 Hoffman ..... A47B 88/493 312/334.44
6,056,157 A 5/2000 Gehl et al.
6,223,944 B1 * 5/2001 Gehl ..... B67D 3/047 222/105
6,561,383 B1 5/2003 Reddy et al.
6,708,741 B1 3/2004 Berry et al.
6,726,061 B2 4/2004 Good
6,871,015 B2 3/2005 Gutierrez et al.
7,076,966 B2 7/2006 Mullen
7,147,134 B2 12/2006 Gutierrez et al.
7,320,416 B2 1/2008 Miller et al.
7,690,405 B2 4/2010 Miller et al.
7,789,269 B2 9/2010 Pritchard
8,091,735 B2 1/2012 Girard et al.
8,171,757 B2 5/2012 Dahlke
8,690,016 B2 4/2014 Anderson et al.
8,827,388 B2 * 9/2014 Johansson ..... E05F 1/16 312/333
8,887,960 B2 11/2014 Hardman
9,045,260 B2 * 6/2015 Norris ..... B67D 3/0029
9,090,443 B1 7/2015 Malinski
9,546,086 B2 1/2017 Samson
10,470,597 B2 * 11/2019 Gehl ..... A47G 19/183
10,822,220 B1 11/2020 Lin
11,667,512 B2 * 6/2023 Krystinik ..... B67D 3/0067 222/1
2004/0065681 A1 4/2004 Floyd et al.
2004/0065682 A1 4/2004 Floyd et al.
2005/0231083 A1 * 10/2005 Garcie ..... A47B 88/467 312/333
2007/0290001 A1 12/2007 Bachrach
2008/0041493 A1 2/2008 Lin et al.
2008/0245816 A1 10/2008 Armstrong et al.
2009/0250490 A1 10/2009 Straza
2009/0283541 A1 11/2009 Compton et al.
2009/0308492 A1 12/2009 Benvenuto et al.
2010/0141106 A1 * 6/2010 Chambers ..... A47B 88/40 312/334.44
2010/0314416 A1 12/2010 Wezner
2011/0253746 A1 10/2011 O'Keefe, Jr.
2011/0278324 A1 11/2011 Kilian et al.
2012/0067920 A1 3/2012 Veltrop et al.
2012/0152976 A1 6/2012 Yoshida et al.
2012/0187158 A1 7/2012 Pritchard
2012/0305595 A1 12/2012 Braun et al.
2012/0318821 A1 12/2012 Merner et al.
2012/0318824 A1 12/2012 McKenna
2014/0166697 A1 6/2014 Rey et al.
2014/0252031 A1 * 9/2014 Norris ..... B65D 35/565 222/105
2015/0102057 A1 4/2015 Gehl et al.
2016/0362288 A1 12/2016 Stratton
2017/0008685 A1 * 1/2017 Stever ..... B65D 77/067
2017/0050764 A1 2/2017 Caul, III
2018/0111816 A1 4/2018 Stever et al.
2018/0327248 A1 11/2018 Grause, Jr.
2020/0276527 A1 * 9/2020 Macoretta ..... B67D 3/0093
2021/0361123 A1 11/2021 De la Cruz

FOREIGN PATENT DOCUMENTS

WO 2016074732 A1 5/2016
WO WO-2016074732 A1 * 5/2016 ..... B67D 3/0029
WO WO-2016090406 A1 * 6/2016 ..... A47B 88/493
WO 2020264296 A1 12/2020
WO WO-2020264296 A1 * 12/2020 ..... B65D 25/2894
WO 2021209690 A1 10/2021
WO WO-2021209690 A1 * 10/2021 ..... B65D 5/064

* cited by examiner

DISPENSING SYSTEM FOR DISPENSING A LIQUID FROM A REPLACEMENT CONTAINER

CROSS-REFERENCE TO RELATED APPLICATION

This application is a continuation of and claims priority to U.S. application Ser. No. 17/702,401, filed Mar. 23, 2022, which claims the benefit of U.S. Provisional Application No. 63/166,665, filed Mar. 26, 2021. Each of these applications is incorporated herein in its entirety by reference thereto.

BACKGROUND

The present disclosure relates to devices and methods to easily and neatly dispense liquids (e.g., laundry detergent) from a replacement container using a reusable dispenser.

BRIEF SUMMARY

Some embodiments disclosed herein are directed to a dispensing system including a container and a dispenser. In some embodiments, the container includes a container body, a dispensing opening, and a seal over the dispensing opening. In some embodiments, the dispenser includes a base, a drawer, a piercing tube, and a dispensing tap. In some embodiments, the base is configured to receive the container. In some embodiments, the drawer is moveable relative to the base between a first position and a second position. In some embodiments, the piercing tube is coupled to and moveable with the drawer. In some embodiments, the dispensing tap is in fluid communication with the piercing tube. In some embodiments, the piercing tube is configured to pierce the seal of container when the container is received in the base and the drawer is moved from the first position to the second position.

In some embodiments, when the container is received in the base and the drawer is in the second position, an interior of the container is in fluid communication with the piercing tube and the dispensing tap.

In some embodiments, the drawer includes an actuator. In some embodiments, when the container is received in the base, the drawer is in the second position, and the actuator is actuated, fluid flows from the container, through the piercing tube, and through the dispensing tap.

In some embodiments, the seal includes an elastomer valve. In some embodiments, the seal includes a slit valve.

In some embodiments, the container includes a venting opening.

In some embodiments, the container contains detergent, fabric softener, or soft soap.

In some embodiments, a bottom support surface of the base extends in a horizontal direction, and a bottom portion of the container is angled relative to the horizontal direction when the container is received in the base.

In some embodiments, when the container is received in the base and the drawer is in the second position, the container is secured to the base. In some embodiments, when the container is received in the base and the drawer is in the first position, the container is removable from the base.

In some embodiments, when the container is received in the base and the drawer is in the second position, the piercing tube is disposed at least partially within an interior of the container.

Some embodiments disclosed herein are directed to a dispenser including a base, a drawer, a piercing tube, and a dispensing tap. In some embodiments, the base is configured to receive a container. In some embodiments, the drawer is moveable relative to the base between a first position and a second position. In some embodiments, the piercing tube is coupled to and moveable with the drawer. In some embodiments, the dispensing tap is in fluid communication with the piercing tube. In some embodiments, the piercing tube is configured to pierce a seal of the container when the container is received in the base and when the drawer is moved from the first position to the second position.

In some embodiments, the base and the drawer define a dispensing area disposed between an upper surface of the base and a bottom surface of the drawer.

In some embodiments, the drawer includes a bottom wall and at least one sidewall defining a compartment. In some embodiments, the piercing tube and the dispensing tap are disposed at least partially within the compartment.

In some embodiments, the dispensing tap includes a first dispensing button, and the drawer includes a second dispensing button configured to contact the first dispensing button such that actuating the second dispensing button actuates the first dispensing button, and releasing the second dispensing button releases the first dispensing button.

In some embodiments, the dispensing tap is coupled to the piercing tube by a threaded connection.

In some embodiments a sensor is configured to measure an amount of fluid dispensed. In some embodiments an electronic system is configured to initiate an order for an additional container.

Some embodiments disclosed herein are directed to a method of dispensing a liquid from a container including disposing a drawer of a dispenser in a first position, disposing a container onto a base of the dispenser, moving the drawer of the dispenser from the first position to a second position, and actuating an actuator of the dispenser. In some embodiments, moving the drawer of the dispenser from the first position to the second position pierces a seal of the container with a piercing tube of the dispenser. In some embodiments, actuating the actuator of the dispenser dispenses liquid from the container and through a dispensing opening of the dispenser.

In some embodiments, moving the drawer from the first position to the second position includes translating the drawer to the second position.

In some embodiments, moving the drawer from the first position to the second position includes pushing the drawer to the second position.

BRIEF DESCRIPTION OF THE FIGURES

The accompanying drawings, which are incorporated herein and form a part of the specification, illustrate the embodiments and, together with the description, further serve to explain the principles of the embodiments and to enable a person skilled in the relevant art(s) to make and use the embodiments.

DETAILED DESCRIPTION

Some liquids (e.g., laundry detergent, fabric softener, soft soaps, hair products, and cleaning liquids) can be purchased in large volumes and used in smaller quantities over time. However, handling larger volume containers (e.g., to pour out a quantity of liquid) may be cumbersome for a user, and thus a stationary dispensing system would be desirable.

It would be desirable for the stationary dispensing system to include a reusable dispenser and a replaceable container (e.g., cartridge, bottle, etc.). It would also be desirable for the dispenser to include features such as monitoring the amount of liquid remaining in the container and automatically re-ordering a new container when the liquid level runs low.

It would also be desirable for a dispensing system to include a reusable dispenser and a replaceable container so that, for example, replacement container are cheaper to produce and/or ship in comparison to container including a dispensing means with the container.

Some embodiments of the present disclosure provide a dispensing system that can be used to easily unseal a replacement container and dispense a liquid stored in the container.

As will be described in more detail below, the dispensing system can include a container and dispenser. The container can include a dispensing opening and a seal over the dispensing opening. The dispenser can include a base and a drawer that slides relative to the base between a first position and a second position. A piercing tube can be coupled to and movable with the drawer, and a dispensing tap can be coupled to the piercing tube.

To use the dispensing system, a user places the drawer of the dispenser in the first position. The user then places the container onto the dispenser. Next, the user moves the drawer from the first position to the second position. Moving the drawer from the first position to the second position causes the piercing tube coupled to the drawer to pierce the seal of the container. With the drawer in the second position, the piercing tube passes through the seal of the container and into an interior of the container. Liquid stored inside the container can then flow from the interior of the container, through the piercing tube, and to the dispensing tap connected to the piercing tube.

These and other embodiments are discussed below in more detail with reference to the figures.

Figure 1:
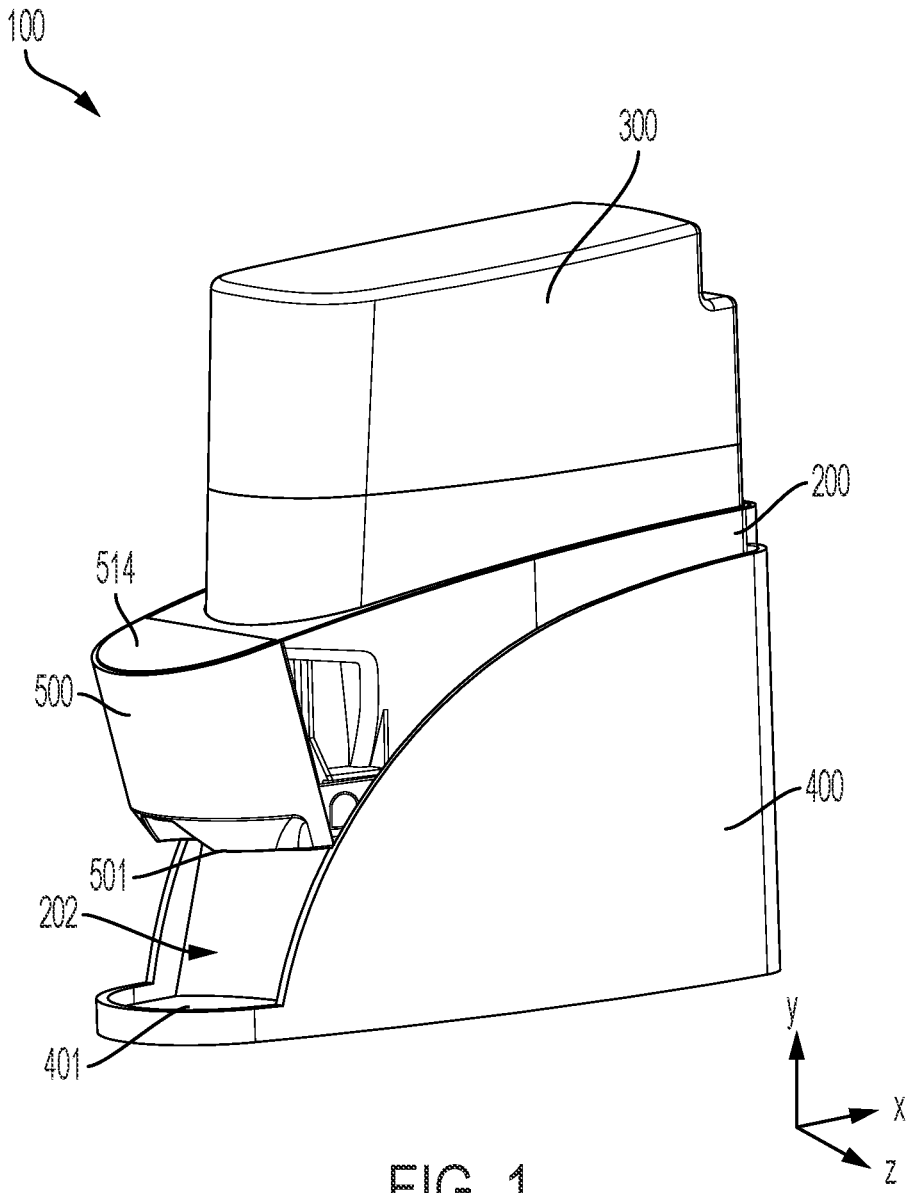
FIG. 1 is a perspective view of a dispensing system according to some embodiments.
Figure 2:
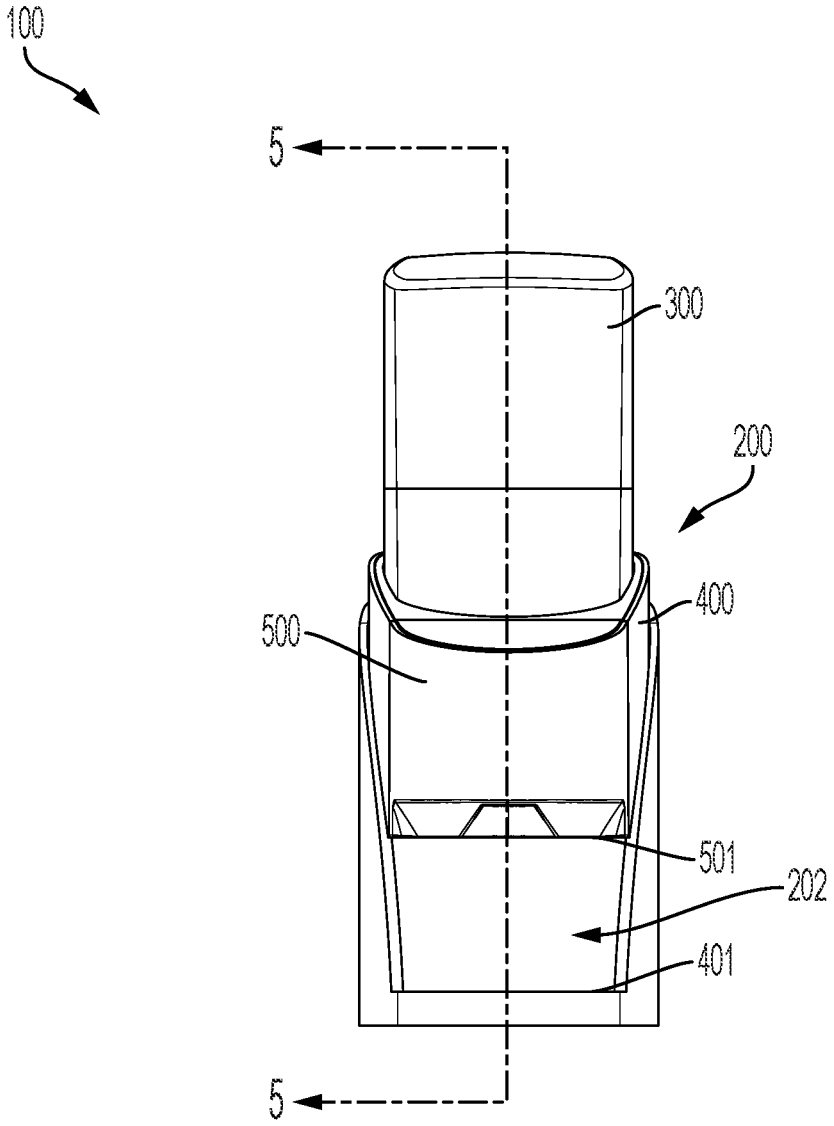
FIG. 2 is a front view of the dispensing system of FIG. 1.

FIGS. 1 and 2 show a dispensing system 100 according to some embodiments. Dispensing system 100 can include a dispenser 200 and a container 300. In some embodiments, dispenser 200 can include multiple components, for example, a base 400 and a drawer 500.

In some embodiments, base 400 and drawer 500 can define a dispensing area 202 disposed between a portion 401 of base 400 and a portion 501 of drawer 500. In some embodiments, a liquid stored within container 300 can be dispensed through an opening in a bottom surface of drawer 500 into dispensing area 202 by pressing actuator 514. In some embodiments, a liquid stored within container 300 can be dispensed into a container (e.g., a cup or a cap, such as a laundry detergent cup or cap) placed in dispensing area 202. In some embodiments, a liquid stored within container 300 can be dispensed into a user's hand placed in dispensing area 202.

The position of dispensing area 202 is not limited to the configuration shown in the figures. For example, in some embodiments, dispensing system 100 can be configured to be mounted to a wall or other surface. In some such embodiments, drawer 500 defines a bottom surface of dispensing system 100 and dispensing area 202 can be disposed below the bottom surface. That is, in some embodiments, the portion of base 400 disposed below drawer 500 (see FIG. 1) does not exist, such that the bottom of drawer 500 is the lowest part of (or even with the lowest part of) dispensing system 100. As another example, in some embodiments, dispensing system 100 can be configured to be placed at an edge of a horizontal surface (e.g., a counter or sink edge) with drawer 500 extending past the edge of the horizontal surface. In some such embodiments, drawer 500 defines a bottom surface of dispensing system 100 and dispensing area 202 can be disposed below the bottom surface.

In some embodiments, dispenser 200 can be a smart dispenser. For example, in some embodiments, dispenser 200 can include a sensor configured to measure an amount of fluid dispensed. In some embodiments, the amount of fluid dispensed can be measured, for example, by measuring the amount liquid exiting container 300 or dispenser 200. In some embodiments, the amount of liquid dispensed can be measured, for example, by sensing the amount of liquid left in container 300. In some embodiments, dispenser 200 can include an electronic system configured to initiate an order for an additional container 300. For example, the electronic system of dispenser 200 can purchase an additional container or prompt a user to purchase an additional container (for example, by sending a notification to a user's smartphone or other electronic device). In some embodiments, the electronic system is configured to initiate an order when the level of liquid in container 300 falls below a threshold amount. In some embodiments, the electronic system is configured to initiate an order when the rate of consumption of the liquid from container 300 is above a threshold rate.

Figure 3:
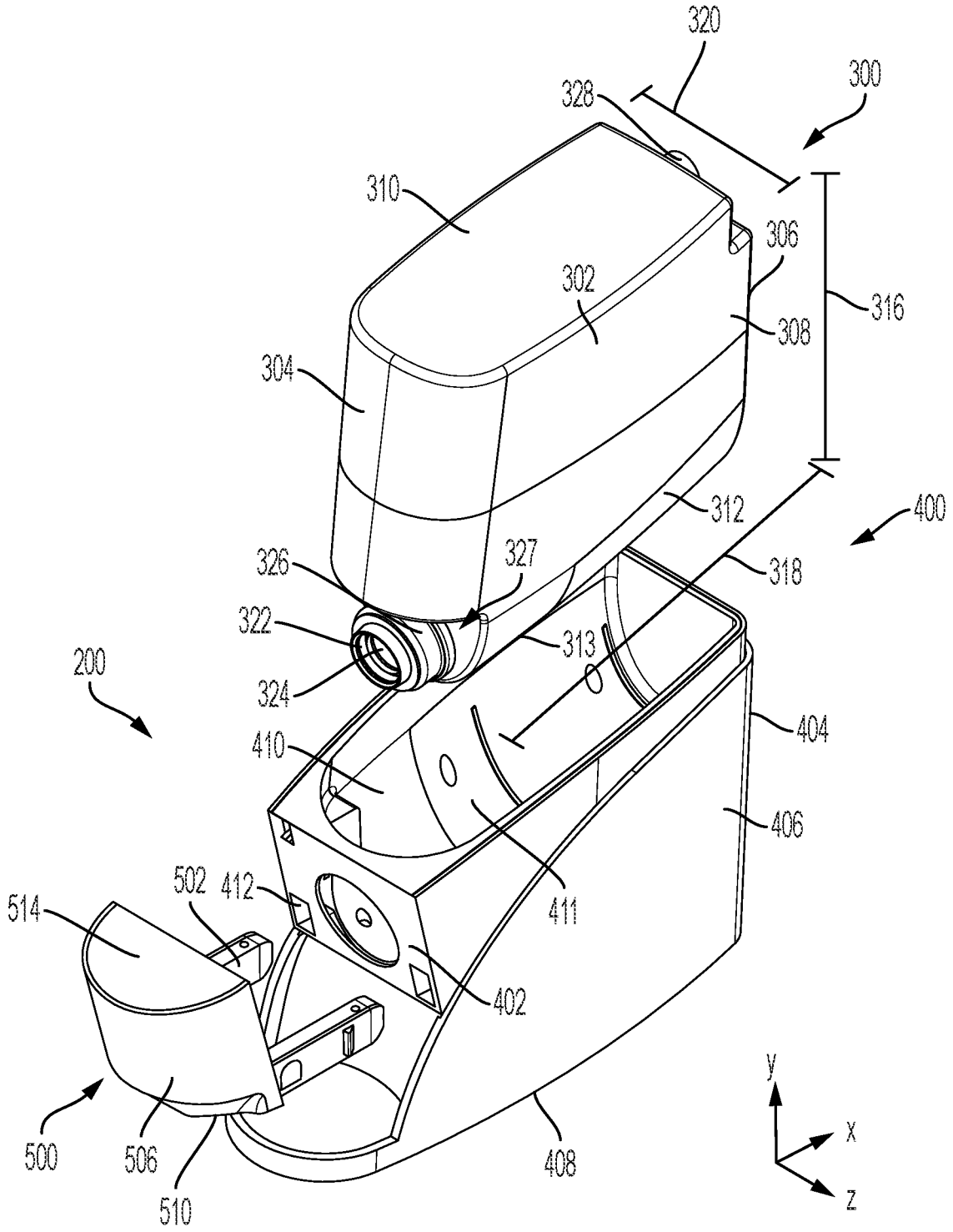
FIG. 3 is a front perspective exploded view of the dispensing system of FIG. 1.
Figure 4:
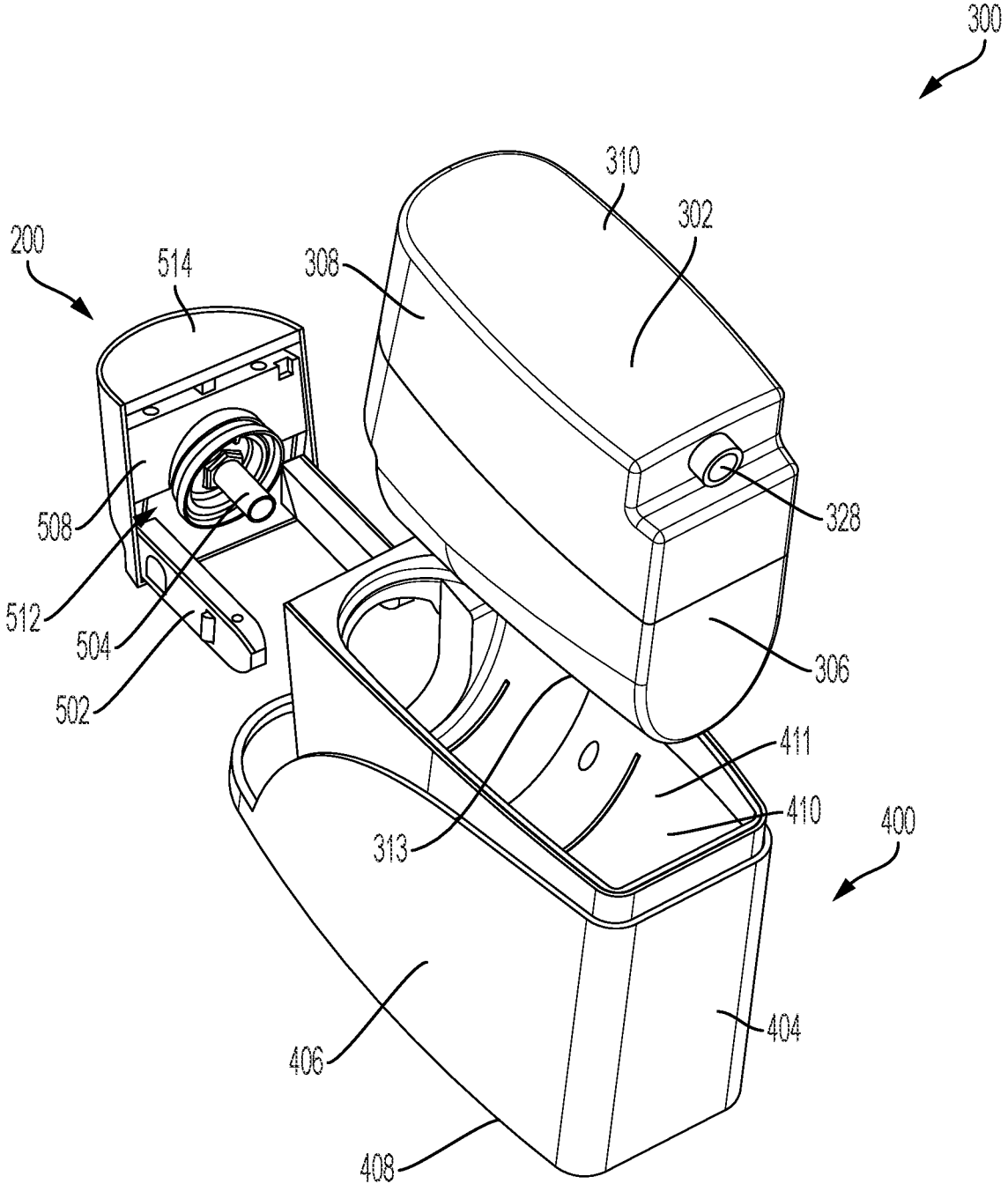
FIG. 4 is a rear perspective exploded view of the dispensing system of FIG. 1.

FIGS. 3 and 4 show exploded views of dispensing system 100 according to some embodiments.

As shown, dispensing system 100 can include container 300, which can include body 302 for holding a liquid. The liquid can be any liquid suitable for dispensing from a container. In some embodiments, the liquid is a detergent (e.g., laundry detergent). In some embodiments, the liquid is a fabric softener. Other suitable liquids (e.g., cleaning products, counter cleaners, toilet cleaners, bath cleaners, soft soaps, dish soaps, hand soaps, face soaps, body washes, hair products (e.g., gels), shampoos, conditioners, or lotions) can be stored in and dispensed from body 302.

Body 302 can have any shape suitable for storing a liquid therein. In the illustrated embodiment, body 302 has a generally rectangular prism shape. However, in other embodiments, body 302 can have another shape (e.g., generally cylindrical). As shown in FIG. 3, for example, body 302 can include a front wall 304, a rear wall 306, side walls 308, top wall 310, and bottom wall 312. Body 302 can define an interior volume 314 of container 300.

In some embodiments, interior volume 314 can have a volume of about 0.5 L to about 8 L (e.g., about 1 L to about 5 L or about 2 L to about 5 L). In some embodiments, interior volume 314 has a volume of about 3 L. In some embodiments, the liquid is disposed in interior volume 314.

As shown in FIG. 3, for example, body 302 can have height 316 in the Y-direction, a length 318 in the X-direction, and a width 320 in the Z-direction. In some embodiments, height 316 can be between about 100 mm to about 400 mm (e.g., about 150 mm to about 300 mm or about 200 mm to about 250 mm). In some embodiments, height 316 is about 225 mm. In some embodiments, length 318 can be between about 100 mm to about 400 mm (e.g., about 125 mm to about 300 mm or about 150 mm to about 250 mm). In some embodiments, length 318 is about 200 mm. In some embodiments, width 320 is about 50 mm to about 200 mm (e.g., about 60 mm to about 150 mm or about 80 mm to about 100 mm). In some embodiments, width 320 is about 90 mm.

In some embodiments, body 302 defines a dispensing opening 322 (shown, for example, in FIG. 3). Dispensing opening 322 can be disposed near a bottom of container 300 such that liquid stored in container 300 flows to dispensing opening 322 when container 300 is in an upright position.

In some embodiments, container 300 includes a seal 324 over dispensing opening 322. As will be discussed in greater detail, seal 324 can have any shape and configuration sufficient to close dispensing opening 322 to prevent liquid from flowing out of dispensing opening 322 (e.g., prior to use, during transport, when shipping), yet allow a piercing tube 504 (shown, for example, in FIG. 7) to be inserted therethrough. In some embodiments, when seal 324 closes dispensing opening 322, seal 324 inhibits the passage of liquid stored in container 300.

Seal 324 can be a separate component coupled to container 300 (e.g., by an adhesive) or can be integrally formed as part of container 300. In some embodiments, seal 324 can be injection molded with container body 302.

In some embodiments, container body 302 can define a neck 326 protruding from a lower portion of container body 302. As shown in FIG. 3, for example, neck 326 can be disposed in a recess 327 defined by body 302 such that front wall 304 of body 302 extends farther forward than a front portion of neck 326 and bottom wall 312 of body 302 extends farther downward than a bottom portion of neck 326.

In some embodiments, seal 324 closes dispensing opening 322 inside neck 326. However, seal 324 can seal dispensing opening 322 in any other suitable manner (for example, by sealing over dispensing opening 322).

In some embodiments, container body 302 defines a venting opening 328 (shown, for example, in FIG. 4) to allow air to flow from outside container 300 into interior volume 314 of container 300 to replace liquid dispensed from container 300.

As shown, for example, in FIG. 3, dispensing system 100 can also include dispenser 200. In some embodiments, dispenser 200 can include multiple components, including base 400 and drawer 500.

Base 400 can have any shape suitable for receiving and holding container 300. As shown in FIG. 3, for example, base 400 can include a front wall 402, a rear wall 404, side walls 406, and a bottom support surface 408.

As shown in FIG. 3, base 400 of dispenser 200 can include a receiving portion 410, for example, at a top of base 400. Receiving portion 410 can have a shape which complements a shape of container body 302 such that an upper surface 411 of receiving portion 410 contacts a lower portion 313 of body 302 when body 302 is disposed in receiving portion 410. For example, as shown in FIG. 3, container body 302 can have a curved bottom surface and receiving portion 410 can have a corresponding curved upper surface. When body 302 is disposed in receiving portion 410, an upper surface of receiving portion 410 can contact a lower portion of body 302.

In some embodiments (for example, as shown in FIG. 1), when container body 302 is placed in receiving portion 410, front wall 402, rear wall 404, and/or side walls 406 of base 400 can extend around a bottom portion of container body 302. This can, for example, help keep container 300 in a stable position relative to base 400 or hide portions of container 300 from a user's view. In some embodiments, placing container body 302 in receiving portion 410 can create an interference fit to secure container body 302 in receiving portion 410 of base 400.

In some embodiments, body 302 of container 300 and base 400 are shaped such that container 300 can be placed in base 400 in only a single orientation. For example, as illustrated in FIG. 3, container 300 can be placed onto base 400 only in its upright position. This can, for example, help place seal 324 at a particular position (e.g., location and/or angle) so that, for example, seal 324 can be pierced, as will be discussed.

As shown in FIG. 3, dispenser 200 can also include drawer 500. In some embodiments, drawer 500 can define a compartment 512 (see FIG. 5). For example, as shown in FIG. 3, drawer 500 can include a front/side wall 506, a rear wall 508 (see FIG. 4), and a bottom wall 510. Front/side wall 506, rear wall 508, and bottom wall 510 of drawer 500 can define compartment 512. In some embodiments, drawer 500 is formed as a tray. Drawer 500 can be formed of any suitable material (e.g., plastic) and can, for example, be a molded component.

In some embodiments, drawer 500 can be movably coupled to base 400. For example, in some embodiments, drawer 500 can translate relative to base 400. As shown in FIG. 3, for example, drawer 500 includes rails 502 which can be coupled to channels 412 provided in base 400 to allow drawer 500 to translate relative to base 400.

Figure 7:
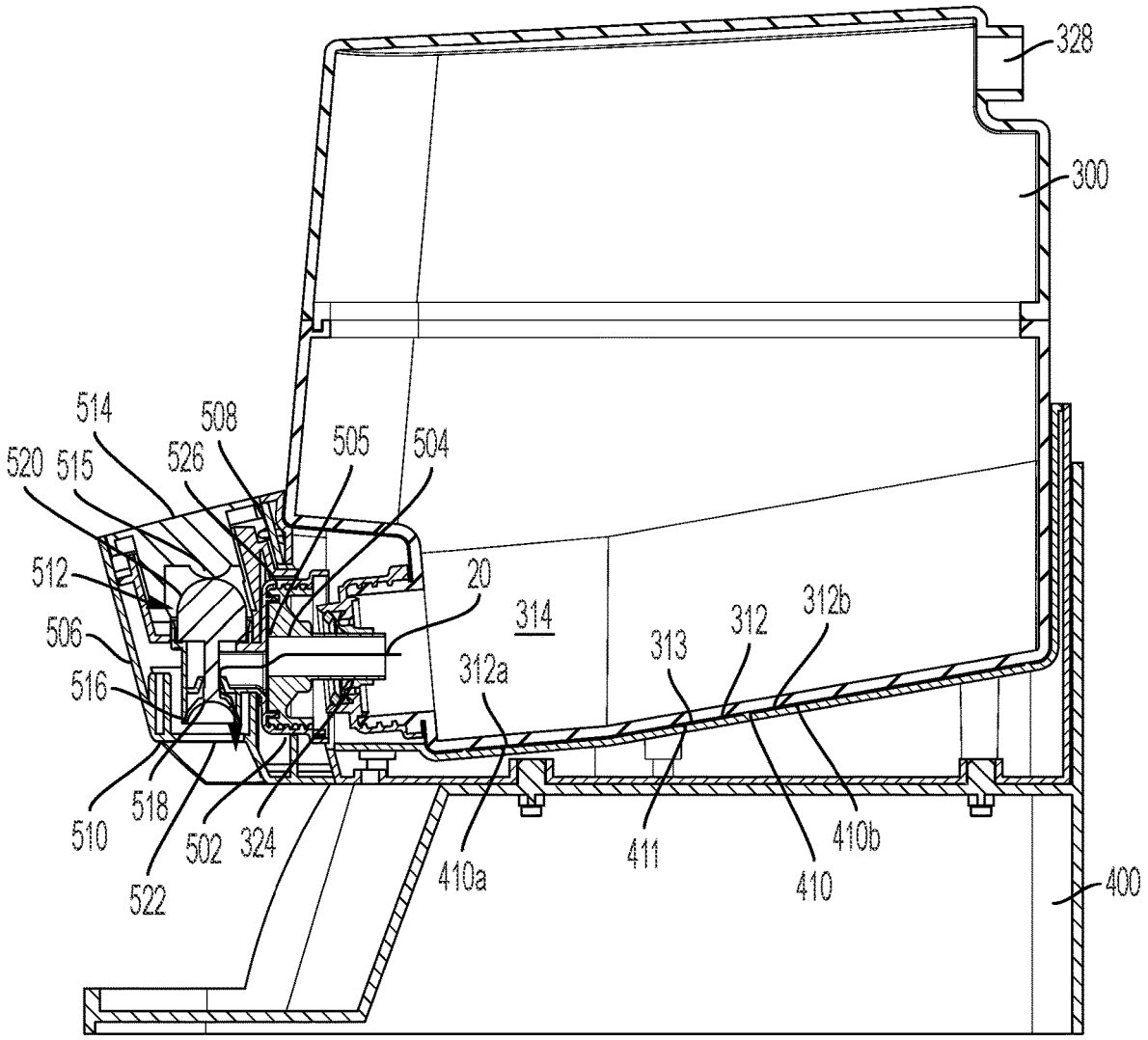
FIG. 7 shows a cross-section of the dispensing system of FIG. 1, with a drawer of the dispensing system in a second position, taken along line 5-5 of FIG. 2.

In some embodiments, drawer 500 can move (e.g., translate) between a first position (for example, the open position shown in FIG. 5) and a second position (for example, the closed position shown in FIG. 7). In some embodiments, drawer 500 translates horizontally. However, drawer 500 can translate at an angle relative to horizontal.

In some embodiments, for example, as shown in FIG. 4, a piercing tube 504 is coupled to and movable with drawer 500. In some embodiments, piercing tube 504 extends horizontally toward base 400. However, in other embodiments, piercing tube 504 can extend toward base 400 at an angle relative to horizontal. For example, in some embodiments, piercing tube 504 can extend at an upward angle (e.g., about 2 to about 10 degrees) toward base 400. The interaction of drawer 500 (and piercing tube 504) with container 300 (and seal 324) is describes, for example, with reference to FIGS. 5-8.

Figure 8:
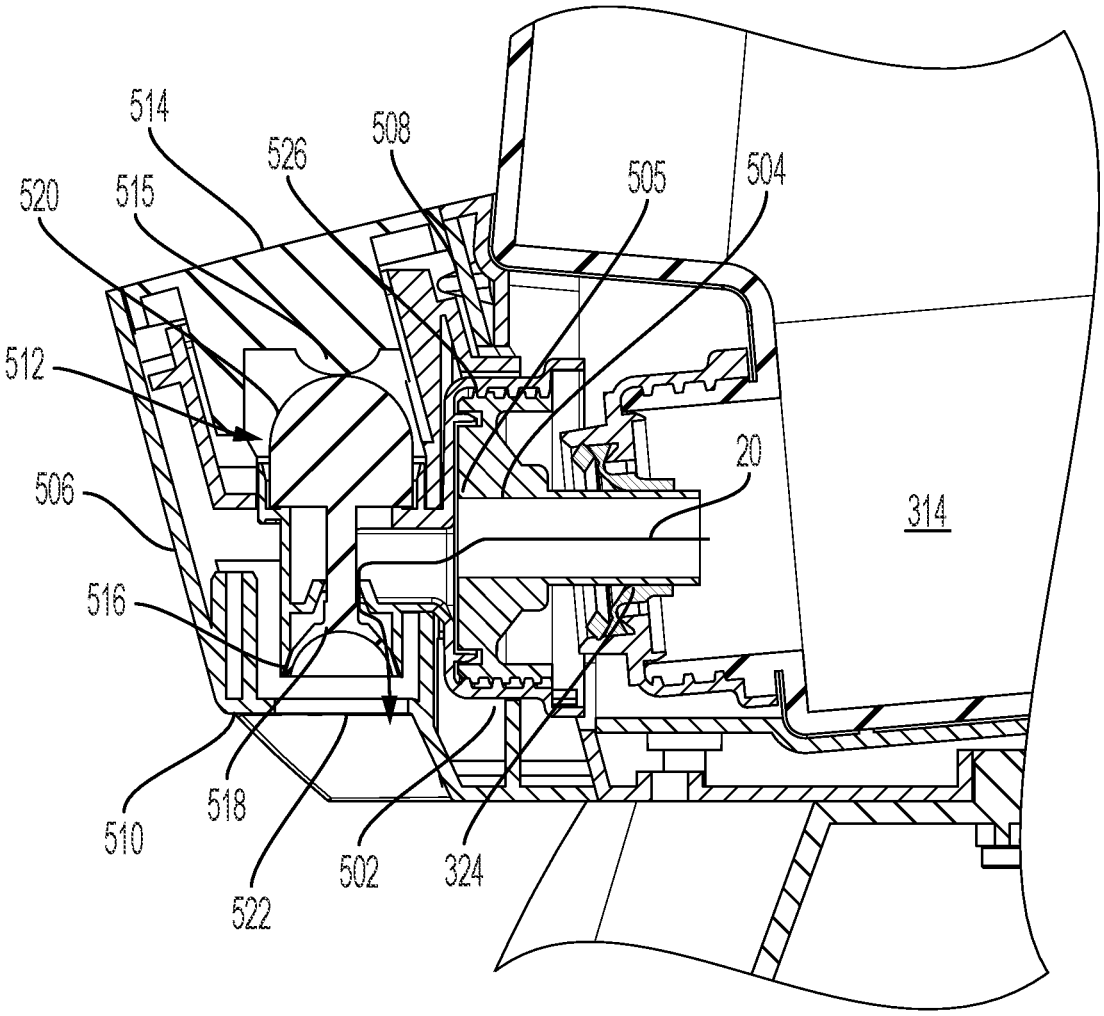
FIG. 8 shows an enlarged view of a portion of FIG. 7.

FIGS. 5-8 are cross-sectional views showing relative positions of certain components of dispensing system 100 during operation. These figures illustrate portions of dispenser 200 and container 300 when drawer 500 is in the first position (FIGS. 5 and 6) and the second position (FIGS. 7 and 8).

Figure 5:
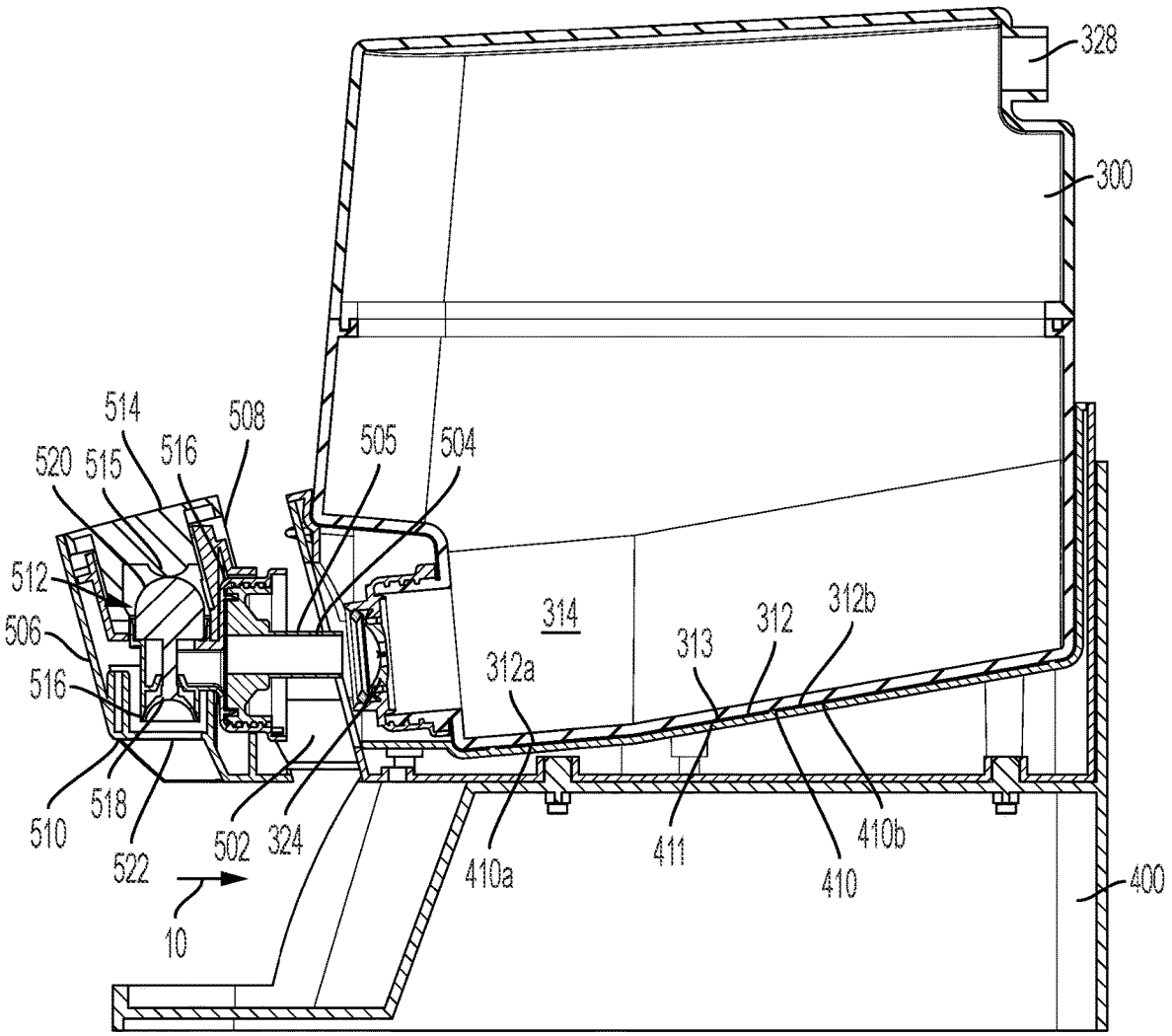
FIG. 5 shows a cross-section of the dispensing system of FIG. 1, with a drawer of the dispensing system in a first position, taken along line 5-5 of FIG. 2.
Figure 6:
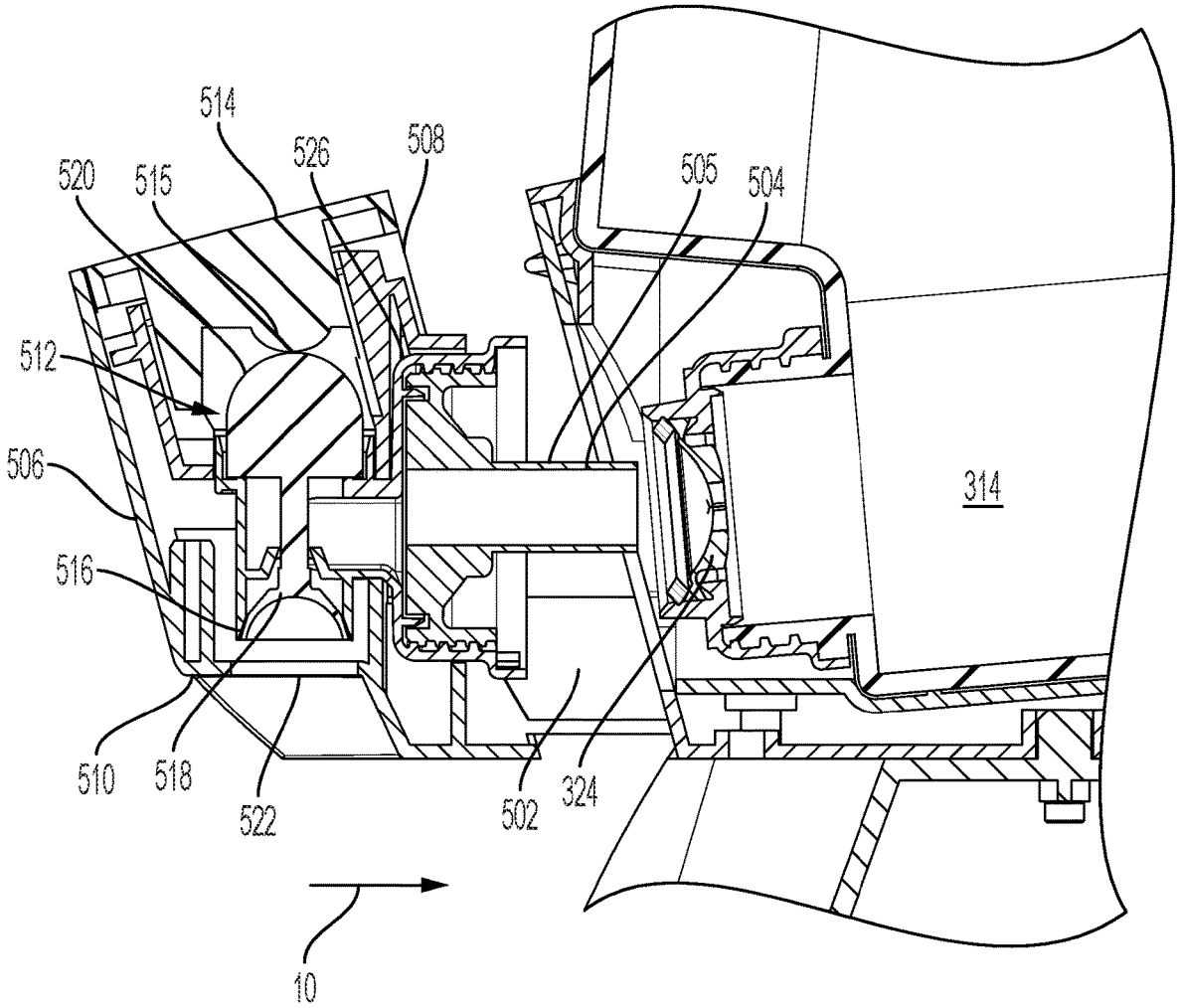
FIG. 6 shows an enlarged view of a portion of FIG. 5.

In FIGS. 5 and 6, drawer 500 is in the first position relative to base 400. As shown, in some embodiments, drawer 500 can define compartment 512. In some embodiments, a dispensing tap 516 is disposed within compartment 512, and an opening 522 can be provided in bottom wall 224 of drawer 500 below dispensing tap 516. In some embodiments, dispensing tap 516 can include a plunger 518 that is configured to move from a closed position to an open position (shown, for example, in FIG. 5) in response to a force applied to dispensing tap actuator 520. For example, in response to a downward force applied to dispensing tap actuator 520, plunger 518 can move downward from a closed position to an open position to create a flow path through dispensing tap 516.

In some embodiments, drawer 500 can include an actuator 514 that is movable relative walls 506, 508. In some embodiments, an inner surface of actuator 514 can include an extension 515 configured to contact dispensing tap actuator 520. In some embodiments, actuating drawer actuator 514 can actuate dispensing tap actuator 520. For example, as shown in FIG. 5, in response to a downward force applied to drawer actuator 514, extension 515 can apply a downward force to dispensing tap actuator 520. In turn, in response to the downward force applied to dispensing tap actuator 520, plunger 518 can move downward from a closed position to an open position to create a flow path through dispensing tap 516.

In some embodiments, releasing drawer actuator 514 can release the dispensing tap actuator 520. For example, dispensing tap actuator 520 can be biased to a closed position, and releasing drawer actuator 514 can remove the downward force holding the dispensing tap actuator in the open position. Thus, in response to removing a force applied to drawer actuator 514, plunger 518 can move upward from an open position to a closed position to close the flow path through dispensing tap 516.

As shown, for example, in FIG. 5, when drawer 500 is in the first position, piercing tube 504 is disposed outside container 300 and substantially outside base 400. With drawer 500 in the first position, container 300 can be placed onto base 400 or removed from base 400 (for example to replace container 300 with a new container).

In some embodiments seal 324 is resealable. Thus, in some embodiments, when drawer 500 is in the first position, seal 324 closes dispensing opening 322 regardless of whether seal 324 has previously been pierced. As a result, container 300 can be placed onto base 400 or removed from base 400 without the contents of container 300 leaking from dispensing opening 322.

As can be seen in FIG. 5, in some embodiments, at least a portion of bottom wall 312 of container 300 can be angled relative to horizontal (for example, bottom support surface 408 of base 400 can define a horizontal direction, and thus horizontal as used herein can mean a direction parallel to bottom support surface 408 of base 400) when container 300 is placed on dispenser 200. This angle can, for example, help direct a liquid stored within container 300 toward dispensing opening 322 when container 300 is placed onto dispenser 200. In some embodiments, for example, at least a portion of bottom wall 312 (e.g., portion 312*a*) can be angled at about 2 degrees to about 20 degrees (e.g., about 5 degrees to about 10 degrees). In some embodiments, bottom wall 312 can include a first angled portion 312*a* and a second angled portion 312*b* having different angles. As shown, for example, in FIG. 5, first angled portion 312*a* can be positioned toward a front of container 300 and can be angled at about 5 degrees relative to horizontal, and second angled portion 312*b* can be positioned toward a rear of container 300 and can be angled at about 10 degrees relative to horizontal.

As discussed, receiving portion 410 of base 400 can have a shape complementary to the shape of container 300. Thus, in some embodiments, receiving portion 410 is also angled relative to horizontal. In some embodiments, for example, an upper surface of receiving portion 410 can be angled at about 2 to about 20 degrees (e.g., about 5 degrees to about 10 degrees). In some embodiments, receiving portion 410 can include a first angled portion 410*a* and a second angled portion 410*b* having different angles. As shown, for example, in FIG. 5, first angled portion 410*a* can be positioned toward a front of base 400 and can be angled at about 5 degrees relative to horizontal, and second angled portion 410*b* can be positioned toward a rear of base 400 and can be angled at about 10 degrees relative to horizontal.

As mentioned, and as shown, for example, in FIG. 6, piercing tube 504 can extend from drawer 500 toward base 400. As shown, when drawer 500 is in the first position, piercing tube 504 can be positioned adjacent to seal 324 of container 300. In this position, seal 324 closes container 300 such that a liquid stored within container 300 is inhibited from passing through dispensing opening 322 of container 300.

As illustrated in FIG. 6, for example, piercing tube 504 can be coupled to drawer 500 via a threaded connection with dispensing tap 516 housed within drawer 500. Alternatively, piercing tube 504 can be coupled to drawer 500 and/or dispensing tap 516 via any other suitable attachment mechanism (e.g., a friction fit connection or a snap-fit connection).

As illustrated in FIG. 6, for example, piercing tube 504 is formed separately from drawer 500 and dispensing tap 516. However, piercing tube 504 can be formed integrally with drawer 500 and/or dispensing tap 516.

As mentioned, a user can move (e.g., linearly slide) drawer 500 from the first position (shown in FIGS. 5 and 6) to the second position (shown in FIGS. 7 and 8). In some embodiments, for example, a user moves drawer 500 from the first position to the second position by pushing drawer 500 in the direction of arrow 10.

As drawer 500 moves from the first position to the second position (e.g., in the direction of arrow 10), piercing tube 504 moves toward and eventually contacts and pierces seal 324.

In some embodiments, seal 324 can be or include a one-way valve. For example, seal 324 can be a slit valve (e.g., a double slit valve) that seals dispensing opening 322 and is configured to allow piercing tube 504 to be inserted from an outside of container 300 into interior volume 314 of container 300. Also for example, seal 324 can be an elastomer valve configured to allow piercing tube 504 to be inserted from the outside of container 300 into interior volume 314 of container 300. In some embodiments, seal 324 can be or include a frangible material that seals dispensing opening 322 and is configured to be broken by piercing tube 504 when piercing tube 504 is pressed against seal 324 from the outside of container 300.

Once piercing tube 504 pierces seal 324, a flow path (shown by arrow 20 in FIG. 8) is created from interior volume 314 of container 300, through piercing tube 504, and into dispensing tap 514.

In FIG. 8, drawer 500 is in the second position relative to base 400. When container 300 is received in base 400 and drawer 500 is in this second position, piercing tube 504 is disposed at least partially inside interior volume 314 of container 300. Thus, interior volume 314 of container 300 is in fluid communication with piercing tube 504, which in turn is in fluid communication with dispensing tap 516. Liquid can then be dispensed from container 300, through piercing tube 504, and through dispensing tap 516 by opening dispensing tap 516. As discussed, dispensing tap 516 can be opened, for example, by applying a downward force to dispensing tap actuator 520. In some embodiments, this downward force can be applied directly. In some embodiments, this downward force can be applied by applying a downward force to drawer actuator 514, which in turn can apply a downward force to dispensing tap actuator 520.

In some embodiments, seal 324 seals against (e.g., around) an outer surface 505 of piercing tube 504 when piercing tube 504 is inserted through seal 324, thereby preventing, or at least, reducing leakage of liquid from inside container 300 around an outside of piercing tube 504.

As mentioned, in some embodiments, container 300 includes a venting opening 328 that can, for example, allow air to flow from outside container 300 to interior volume 314 of container 300. This can equalize pressure between an outside of container 300 and interior volume 314 container 300 as liquid is dispensed from container 300. The ability of air to flow from outside container 300 to inside container 300 can help keep a steady flow of liquid through piercing tube 504 and minimize vacuum buildup that could interrupt the flow.

In some embodiments, when container 300 is received in base 400 and drawer 500 is in the second position, container 300 can be is secured to base 400. For example, when container 300 is received in base 400 and drawer 500 is in the second position, piercing tube 504 can be disposed at least partially within interior volume 314 of container 300 (e.g., in dispensing opening 322), thereby inhibiting container 300 from being removed from base 400. In some embodiments, neck 326 of container 300 can at least partially surround piercing tube 504 such that lifting container 300 from base 400 causes piercing tube 504 and neck 326 to interfere.

In some embodiments, to remove container 300 from base 400, a user must move drawer 500 from the second position to, or at least toward, the first position. In some embodiments, moving drawer 500 from the second position to the first position can move piercing tube 504 out from container 300 such that piercing tube 504 no longer interferes with the removal of container 300 and container 300 can be removed from base 400.

In some embodiments, when drawer 500 is moved from the second position to the first position, seal 324 closes to reseal dispensing opening 322. In such embodiments, for example, container 300 can be removed from base 400 with minimal leakage of any liquid stored within container 300 through dispensing opening 322.

Figure 9:
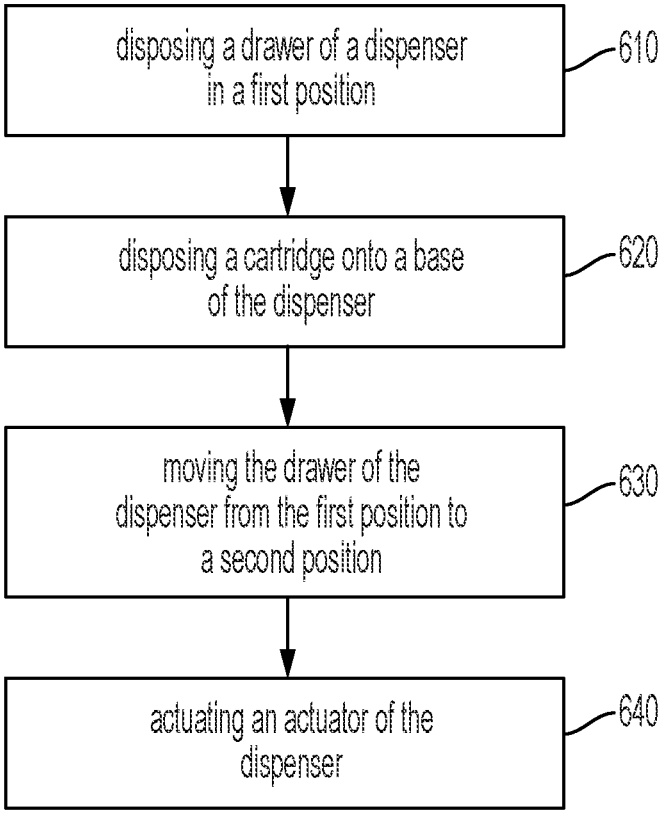
FIG. 9 shows a method for dispensing a liquid from a container according to some embodiments.

As disclosed herein, dispensing system 100 can be used to dispense liquid stored in container 300. FIG. 9 illustrates a flow chart of an example process 600 for using dispensing system 100. At step 610, drawer 500 can be disposed in a first position. At step 620, container 300 can be disposed onto base 400 of dispenser 200. As discussed, container 300 can be placed, for example, in receiving portion 410 of base 400. At step 630, drawer 500 can be moved from the first position to a second position. Moving the drawer 500 to the second position can pierce a seal 324 of container 300 with a piercing tube of dispenser 200. At step 640, an actuator of the dispenser can be actuated to dispense liquid from container 300 through a dispensing opening 322 of dispenser 200.

In some embodiments, moving the drawer from the first position to the second position includes translating the drawer to the second position. In some embodiments, moving the drawer from the first position to the second position includes pushing the drawer to the second position.

As used herein, the terms "upper" and "lower," "top" and "bottom," "front" and "back," "inner" and "outer," and the like are intended to assist in understanding of embodiments of the disclosure with reference to the accompanying drawings with respect to the orientation of the beverage closure as shown, and are not intended to be limiting to the scope of the disclosure or to limit the disclosure scope to the embodiments depicted in the Figures. The directional terms are used for convenience of description and it is understood that embodiments disclosed herein can be positioned in any of various orientations.

The term "about" or "substantially" or "approximately" as used herein refer to a considerable degree or extent. When used in conjunction with, for example, an event, circumstance, characteristic, or property, the term "about" or "substantially" or "approximately" can indicate a value of a given quantity that varies within, for example, 1-15% of the value (e.g., ±1%, ±2%, ±5%, ±10%, or ±15% of the value), such as accounting for typical tolerance levels or variability of the embodiments described herein.

It is to be appreciated that the Detailed Description section, and not any other section, is intended to be used to interpret the claims. Other sections may set forth one or more but not all embodiments of the present disclosure as contemplated by the inventor(s), and thus, are not intended to limit the present disclosure and the appended claims in any way.

The present disclosure has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosure that others can, by applying knowledge within the skill of the art, readily modify and/or adapt for various applications such specific embodiments, without undue experimentation, without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The above examples are illustrative, but not limiting, of the present disclosure. Other suitable modifications and adaptations of the variety of conditions and parameters normally encountered in the field, and which would be apparent to those skilled in the art, are within the spirit and scope of the disclosure.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The breadth and scope of the present disclosure should not be limited by any of the above-described embodiments, but should be defined only in accordance with the claims and their equivalents.

What is claimed is:

1. A dispensing system comprising:

a container comprising:

a container body, a dispensing opening, and a seal over the dispensing opening; and a dispenser comprising:

a base configured to receive the container, a drawer moveable relative to the base between a first position and a second position, a piercing tube coupled to and moveable with the drawer, and a dispensing tap in fluid communication with the piercing tube, wherein the piercing tube is configured to pierce the seal of the container when the container is received in the base and the drawer is moved from the first position to the second position, and wherein the drawer is coupled to the base in both the first position and the second position.

2. The dispensing system of claim 1 wherein, when the container is received in the base and the drawer is in the second position, an interior of the container is in fluid communication with the piercing tube and the dispensing tap.

3. The dispensing system of claim 1, wherein:

the drawer comprises an actuator, and when the container is received in the base, the drawer is in the second position, and the actuator is actuated, fluid flows from the container, through the piercing tube, and through the dispensing tap.

4. The dispensing system of claim 1, wherein the seal comprises an elastomer valve.

5. The dispensing system of claim 1, wherein the seal comprises a slit valve.

6. The dispensing system of claim 1, wherein the container contains detergent, fabric softener, or soft soap.

7. The dispensing system of claim 1, wherein a bottom support surface of the base extends in a horizontal direction, and a bottom portion of the container is angled relative to the horizontal direction when the container is received in the base.

8. The dispensing system of claim 1, wherein:

when the container is received in the base and the drawer is in the second position, the container is secured to the base, and when the container is received in the base and the drawer is in the first position, the container is removable from the base.

9. The dispensing system of claim 8, wherein when the container is received in the base and the drawer is in the second position, the piercing tube is disposed at least partially within an interior of the container.

10. The dispensing system of claim 1, wherein:

the drawer defines a compartment, the dispensing tap is disposed at least partially within the compartment, the drawer comprises an actuator, and when the container is received in the base, the drawer is in the second position, and the actuator is actuated, fluid flows from the container, through the piercing tube, through the dispensing tap, and through a dispensing opening disposed in a bottom wall of the drawer.

11. A dispenser comprising:

a base configured to receive a container;

a drawer moveable relative to the base between a first position and a second position;

a piercing tube coupled to and moveable with the drawer; and a dispensing tap in fluid communication with the piercing tube, wherein the piercing tube is configured to pierce a seal of the container when the container is received in the base and when the drawer is moved from the first position to the second position, and wherein the drawer is coupled to the base in both the first position and the second position.

12. The dispenser of claim 11, wherein the base and the drawer define a dispensing area disposed between an upper surface of the base and a bottom surface of the drawer.

13. The dispenser of claim 11, wherein the drawer comprises a bottom wall and at least one sidewall defining a compartment, and wherein the piercing tube and the dispensing tap are disposed at least partially within the compartment.

14. The dispenser of claim 11, wherein:

the dispensing tap comprises a first dispensing button, and the drawer comprises a second dispensing button configured to contact the first dispensing button such that actuating the second dispensing button actuates the first dispensing button, and releasing the second dispensing button releases the first dispensing button.

15. The dispenser of claim 11, further comprising a sensor configured to measure an amount of fluid dispensed.

16. The dispenser of claim 11, further comprising an electronic system configured to initiate an order for an additional container.

17. The dispenser of claim 11, wherein the drawer comprises a bottom wall and at least one sidewall defining a compartment, wherein the dispensing tap is disposed at least partially within the compartment, and wherein the bottom wall of the drawer defines a dispensing opening in fluid communication with the dispensing tap.

18. The dispenser of claim 11, wherein:

the drawer comprises a guide rail, the base comprises a channel configured to receive the guide rail, and the drawer is moveable between the first position and the second position by translating the guide rail within the channel.

19. A dispenser comprising:

a base configured to receive a container;

a drawer moveable relative to the base between a first position and a second position;

a piercing tube coupled to and moveable with the drawer; and a dispensing tap in fluid communication with the piercing tube, wherein the base comprises a dispensing platform disposed under the dispensing tap, and wherein the piercing tube is configured to pierce a seal of the container when the container is received in the base and when the drawer is moved from the first position to the second position.

20. The dispenser of claim 19, wherein a bottom wall of the drawer defines a dispensing opening in fluid communication with the dispensing tap, and wherein the drawer and the base define a dispensing area disposed between the dispensing platform and the bottom wall of the drawer.

* * * * *